US010594056B2

(12) United States Patent
Kanemura et al.

(10) Patent No.: US 10,594,056 B2
(45) Date of Patent: Mar. 17, 2020

(54) TERMINAL FITTING

(71) Applicant: Sumitomo Wiring Systems, Ltd., Yokkaichi, Mie (JP)

(72) Inventors: Keisuke Kanemura, Mie (JP); Yuichi Nakanishi, Mie (JP); Ai Hirano, Mie (JP); Shohei Mitsui, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/231,646

(22) Filed: Dec. 24, 2018

(65) Prior Publication Data

US 2019/0199013 A1 Jun. 27, 2019

(30) Foreign Application Priority Data

Dec. 26, 2017 (JP) ..... 2017-248728

(51) Int. Cl.

| | |
|---|---|
| ***H01R 9/05*** | (2006.01) |
| ***H01R 4/18*** | (2006.01) |
| ***H01R 13/6581*** | (2011.01) |
| ***H01R 13/6592*** | (2011.01) |
| *H01R 24/56* | (2011.01) |
| *H01R 103/00* | (2006.01) |

(52) U.S. Cl.

CPC ..... *H01R 9/0518* (2013.01); *H01R 4/185* (2013.01); *H01R 13/6581* (2013.01); *H01R 13/6592* (2013.01); *H01R 4/184* (2013.01); *H01R 24/568* (2013.01); *H01R 2103/00* (2013.01)

(58) Field of Classification Search

CPC .... H01R 9/0518; H01R 13/639; H01R 24/44; H01R 4/184; H01R 13/6592; H01R 4/185; H01R 13/6581; H01R 9/053

USPC ..... 439/585

See application file for complete search history.

(56) References Cited

U.S. PATENT DOCUMENTS

| | | | | |
|---|---|---|---|---|
| 5,984,701 | A * | 11/1999 | Sawayanagi | H01R 13/639 439/157 |
| 5,984,710 | A * | 11/1999 | Kodama | H01R 9/053 439/394 |
| 9,450,352 | B2 * | 9/2016 | Miyawaki | H01R 24/44 |
| 2003/0224656 | A1 * | 12/2003 | Yoshida | H01R 9/0518 439/578 |
| 2010/0221949 | A1 * | 9/2010 | Okamoto | H01R 4/184 439/585 |
| 2013/0171873 | A1 * | 7/2013 | Kanda | H01R 13/6581 439/607.51 |
| 2013/0224997 | A1 * | 8/2013 | Miyawaki | H01R 4/184 439/585 |
| 2015/0244085 | A1 | 8/2015 | Miyawaki | |

FOREIGN PATENT DOCUMENTS

| | | |
|---|---|---|
| JP | 2015-162375 | 9/2015 |

* cited by examiner

*Primary Examiner* — Jean F Duverne

(74) *Attorney, Agent, or Firm* — Gerald E. Hespos; Michael J. Porco; Matthew T. Hespos

(57) ABSTRACT

A terminal fitting (T) includes an inner conductor (11), an outer conductor (12) and a dielectric (13) interposed between these conductors. The inner conductor (11) is connected to a core (51) of a shielded cable (W). The outer conductor (12) includes two shield crimping pieces (45) deformable along an outer periphery of a braided wire (53) of the shielded cable (W). Further, the terminal fitting (T) includes a cover (14) including a shield-side surrounding portion (84) for surrounding the shield crimping pieces (45) along outer peripheries thereof.

6 Claims, 16 Drawing Sheets

TERMINAL FITTING

BACKGROUND

Field of the Invention

The invention relates to a terminal fitting.

Related Art

A high-frequency compatible shielded cable often is routed in an automotive vehicle to transmit a high-frequency signal to a circuit board of an electrical device, such as a television or car navigation system mounted in the vehicle. For example, Japanese Unexamined Patent Publication No. 2015-162375 discloses a coaxial cable (shielded cable) with a coaxial connector (terminal fitting) mounted on an end part for connection to an electrical device. The coaxial cable includes an inner conductor terminal, an outer conductor terminal and a dielectric interposed between the inner and outer conductor terminals. The inner conductor terminal is connected to a core of the coaxial cable. The outer conductor terminal includes a hollow cylindrical portion for accommodating the dielectric and the inner conductor terminal on a front part and a shield crimping portion to be crimped to a shield conductor of the coaxial cable via a coupling on a rear part.

Crimping the shield crimping portion at a predetermined compression ratio may deform the shield conductor up or out due to bending deformation of the shield crimping portion. The shield conductor may be a braided wire formed by weaving metal strands into a net and may distort as the shield crimping portion is crimped. The compression ratio of the shield crimping portion may be reduced to prevent distortion of the braided wire. However, the reduced compression ratio may permit projecting pieces of the shield crimping portion to expand so that connection reliability for the shield conductor cannot be ensured.

The invention was completed on the basis of the above situation and aims to provide a terminal fitting capable of ensuring connection reliability and satisfactorily exhibiting a shielding function.

SUMMARY

The invention is directed to a terminal fitting with an outer conductor including two shield crimping pieces deformable along an outer periphery of a shield layer of a shielded cable, and a cover including a surrounding portion for surrounding the shield crimping pieces along outer peripheries thereof.

The two shield crimping pieces can be crimped to the shield layer at a low compression ratio to prevent deformation and fracture of the shield layer. Thus, a shield layer in the form of a braided wire will not distort and an opening diameter can be made substantially uniform. There generally is a concern that the shield crimping pieces may open if the compression ratio is low. However, the surrounding portion of the subject invention surrounds the outer peripheries of the shield crimping pieces to suppress opening of the shield crimping pieces. As a result, the shield crimping pieces remain crimped to the shield layer and a satisfactory shielding function can be exhibited.

The two shield crimping pieces may rise from a body of the outer conductor. The surrounding portion may include two strips rising from a body of the cover and may be deformable along the outer peripheries of the shield crimping pieces. The body of the cover may cover tips of the shield crimping pieces to reliably suppress the opening of the shield crimping pieces.

The body of the outer conductor may include a locking hole, and tips of the strips may enter the locking hole to be locked to the outer conductor. Thus, the locking hole of the outer conductor reliably suppresses opening of the strip pieces and thereby further suppresses opening of the shield crimping pieces.

The terminal fitting may include an inner conductor having a center conductor crimping portion to be crimped to a center conductor of the shielded cable. The outer conductor may include a coupling, and the center conductor crimping portion may be disposed inside the coupling. The coupling may have an opening, and the cover may close the opening and electrically contact the outer conductor. Thus, a satisfactory flow of a current can be ensured and high frequency performance can be improved despite the presence of the opening. The cover functions to suppress opening of the shield crimping pieces and also functions to improve high frequency performance. Thus, the configuration of the terminal fitting can be simplified and the number of components can be reduced as compared to the case where these functions are realized by separate members.

DETAILED DESCRIPTION

Figure 1:
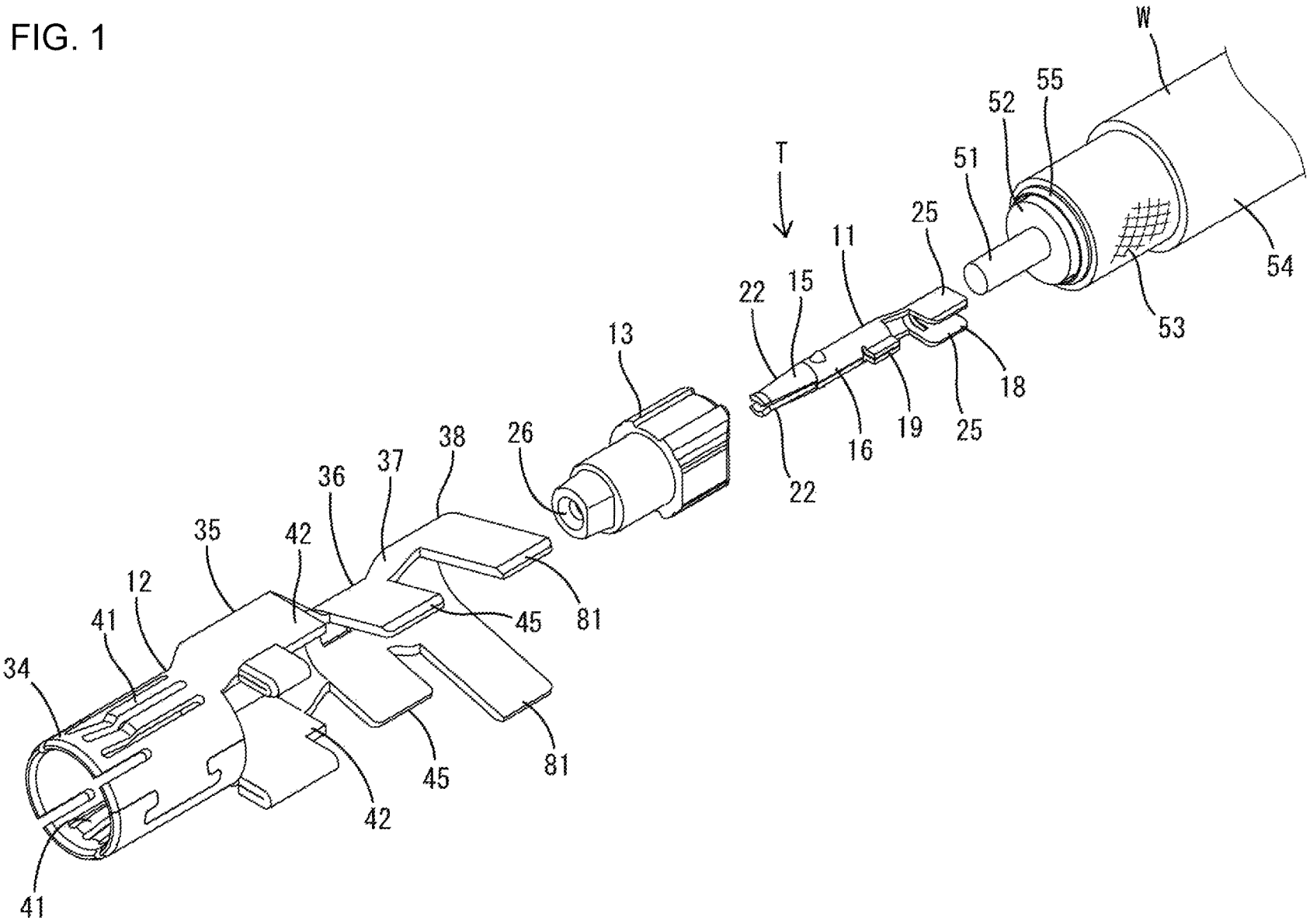
FIG. 1 is an exploded perspective view of a terminal fitting except a cover in one embodiment of the present invention.
Figure 2:
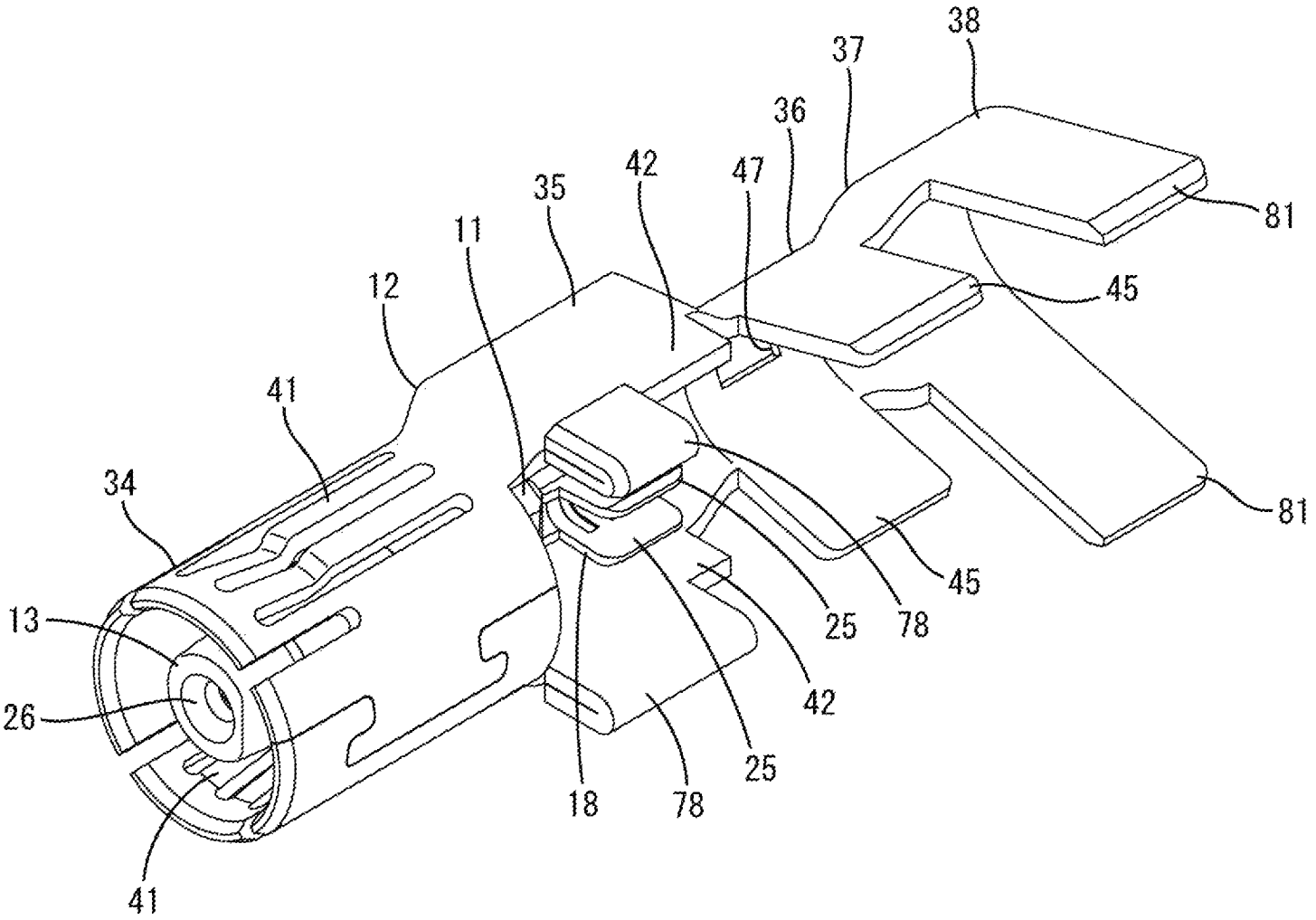
FIG. 2 is a perspective view of an outer conductor assembled with an inner conductor and a dielectric.

An embodiment is described with reference to the drawings. A terminal fitting T according to this embodiment is connected to an end part of a shielded cable W and includes, as shown in FIG. 1, an inner conductor 11, an outer conductor 12, a dielectric 13 and a cover 14. The inner conductor 11, the outer conductor 12 and the cover 14 are made of a conductive metal, and the dielectric 13 is made of an insulating synthetic resin. This terminal fitting T is connected electrically to a mating terminal fitting 60 from the front.

As shown in FIG. 1, the shielded cable W is a so-called coaxial cable and includes a conductive core 51 (center conductor) formed by twisting a plurality of strands, an insulating coating 52 surrounding the outer periphery of the core 51, a conductive braided wire 53 (shield layer) formed by weaving strands into a net that surrounds the outer periphery of the coating 52 and an insulating sheath 54 surrounding the outer periphery of the braided wire 53. The core 51 functions to transmit a high-frequency signal and the braided wire 53 functions to shield electromagnetic waves. The shielded cable W has the sheath 54 and the coating 52 stripped to successively expose the core 51 and the braided wire 53 from an end. A sleeve 55 for receiving a crimping load is inserted between the coating 52 and the braided wire 53.

Figure 13:
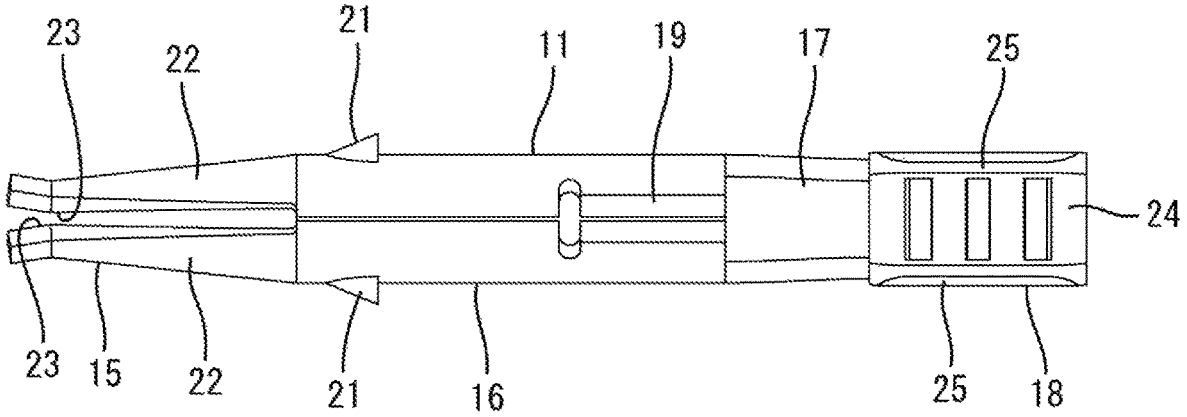
FIG. 13 is a view of the inner conductor viewed from the side of center conductor crimping pieces.

The inner conductor 11 is formed, such as by bending a metal plate, and is configured by successively connecting a mating connecting portion 15, a tubular portion 16, a linking portion 17 and a center conductor crimping portion 18 from a front side to a rear side as shown in FIG. 13.

The tubular portion 16 has a circular cross-sectional shape long and narrow in a front-rear direction (lateral direction of FIG. 13), and has ends are butted against each other along the front-rear direction. The tubular portion 16 includes a contact stop 19 on rear parts of the butting ends. The contact stop 19 is formed such that two plate pieces rise while being held in close contact with each other. Further, the tubular portion 16 includes two claw-like locking projections 21 on both sides across the butting ends.

The mating connecting portion 15 is composed of two resilient pieces 22 projecting forward from parts of the tubular portion 16 on both sides of the butting ends. The resilient pieces 22 are arranged to face each other across a slit extending in the front-rear direction and include, on tip sides, contacts 23 having inner surfaces to be brought into contact with a later-described tab 64 of the mating terminal fitting 60, and parts of the resilient pieces 22 before the contacts 23 are expanded to guide the tab 64.

The link 17 is configured as a plate connected to a part of the tubular portion 16 opposite to the butting ends and has a substantially U-shaped cross-section. The center conductor crimping portion 18 includes a center conductor-side body 24 connected to the rear end of the link 17 and two center conductor crimping pieces 25 in the form of an open barrel and projecting on both sides of the center conductor-body 24.

Figure 4:
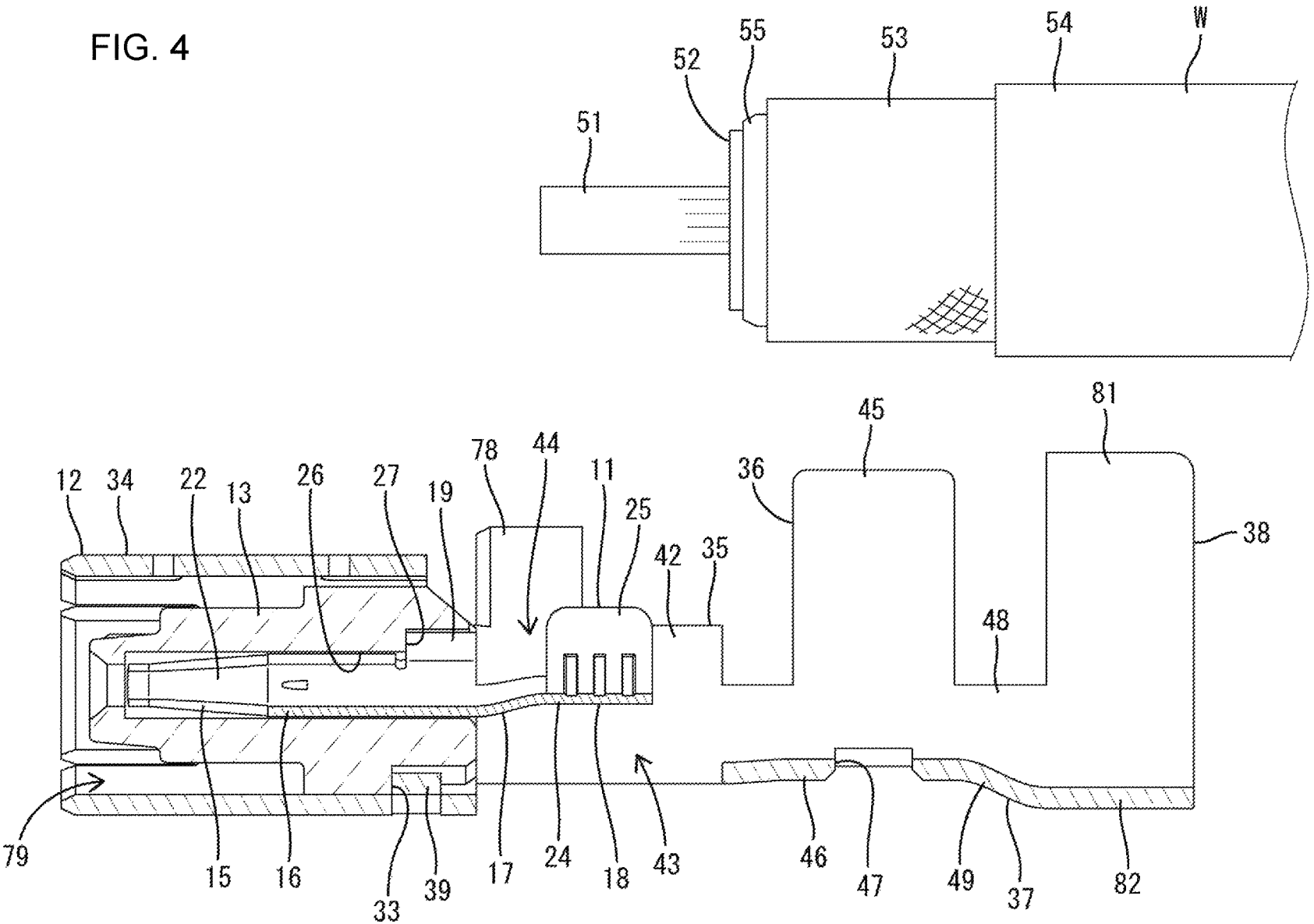
FIG. 4 is a section of the outer conductor assembled with the inner conductor and the dielectric in a state before a shielded cable is set.
Figure 5:
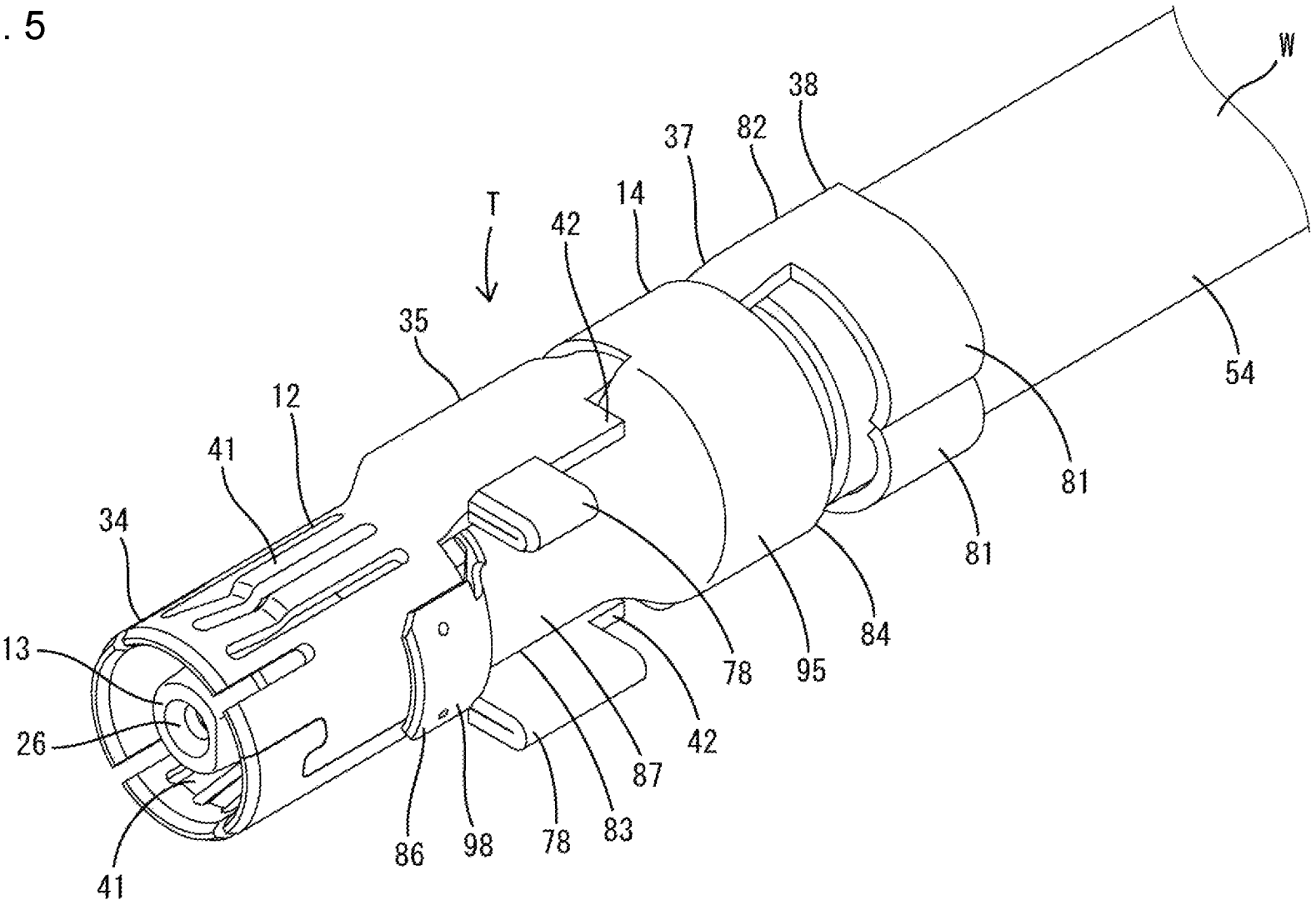
FIG. 5 is perspective view of the terminal fitting.
Figure 14:
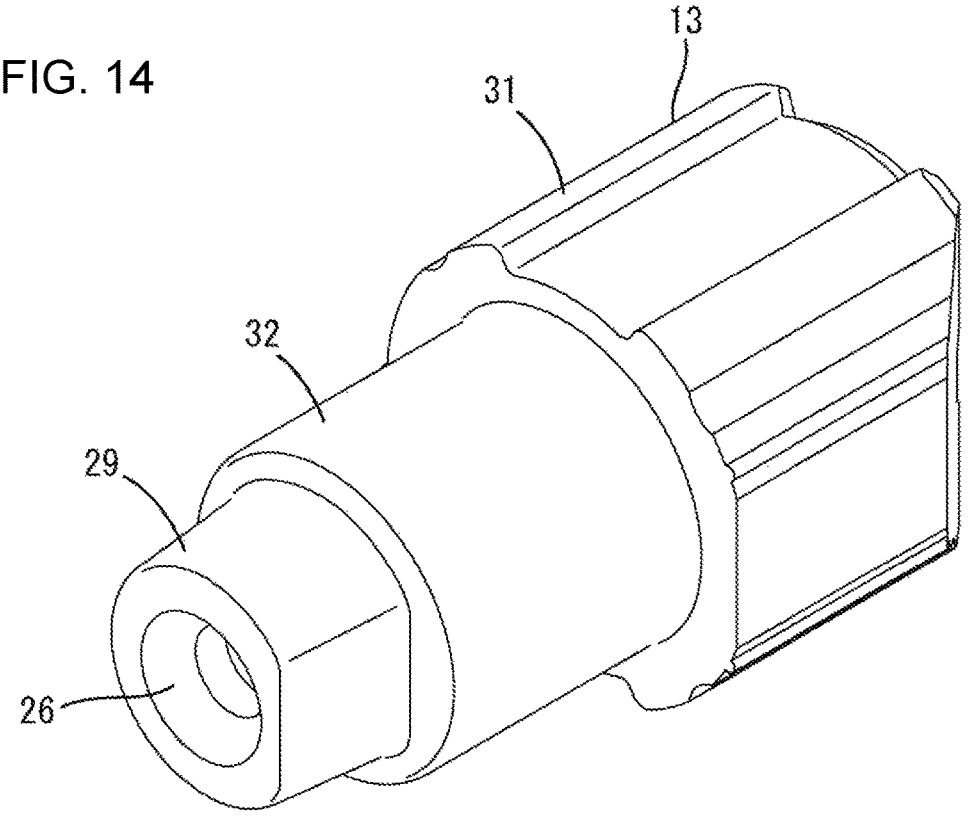
FIG. 14 is a perspective view of the dielectric.
Figure 15:
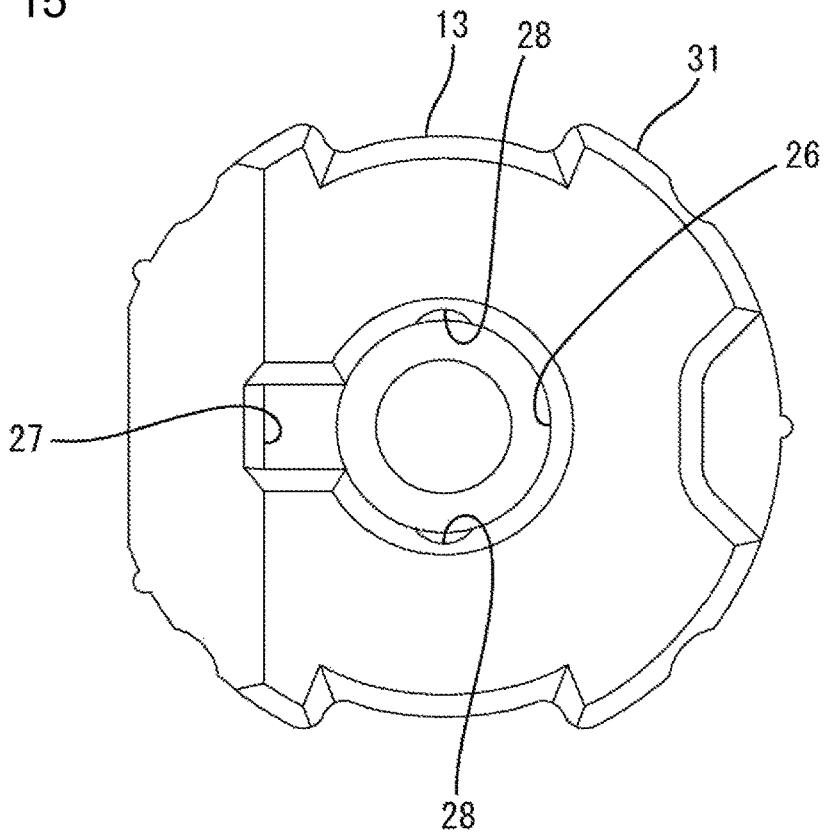
FIG. 15 is a back view of the dielectric.

As shown in FIG. 14, the dielectric 13 has a tubular shape and includes an inner conductor insertion hole 26 penetrating in the front-rear direction and having a circular cross-section. As shown in FIG. 15, the dielectric 13 includes a contact stop receiving portion 27 in the form of a rectangular recess formed by cutting a rear end part of the inner surface of the inner conductor insertion hole 26, and two projection receiving portions 28 in the form of curved recesses on both sides of the inner surface of the inner conductor insertion hole 26 across the contact stop receiving portion 27. The inner conductor 11 is inserted into the inner conductor insertion hole 26 of the dielectric 13 from behind. As shown in FIG. 4, the contact stop 19 enters the contact stop receiving portion 27 and contacts the front end of the contact stop receiving portion 27 to stop the inner conductor 11 in the dielectric 13 from the front. Additionally, the locking projections 21 enter the corresponding projection receiving portions 28 and lock the inner surfaces of the projection receiving portions 28 to retain the inner conductor 11 in the inner conductor insertion hole 26.

As shown in FIG. 14, the outer surface of the dielectric 13 is expanded in diameter in a stepwise manner from a front end to a rear end and includes a front circumferential surface 29 partly having a flat surface on a front small-diameter part, a rear variant surface 31 having a variant (noncircular) cross-section on a rear large-diameter part, and an intermediate circumferential surface 32 having a circular cross-sectional shape on a medium-diameter part between the rear variant surface 31 and the front circumferential surface 29.

Figure 12:
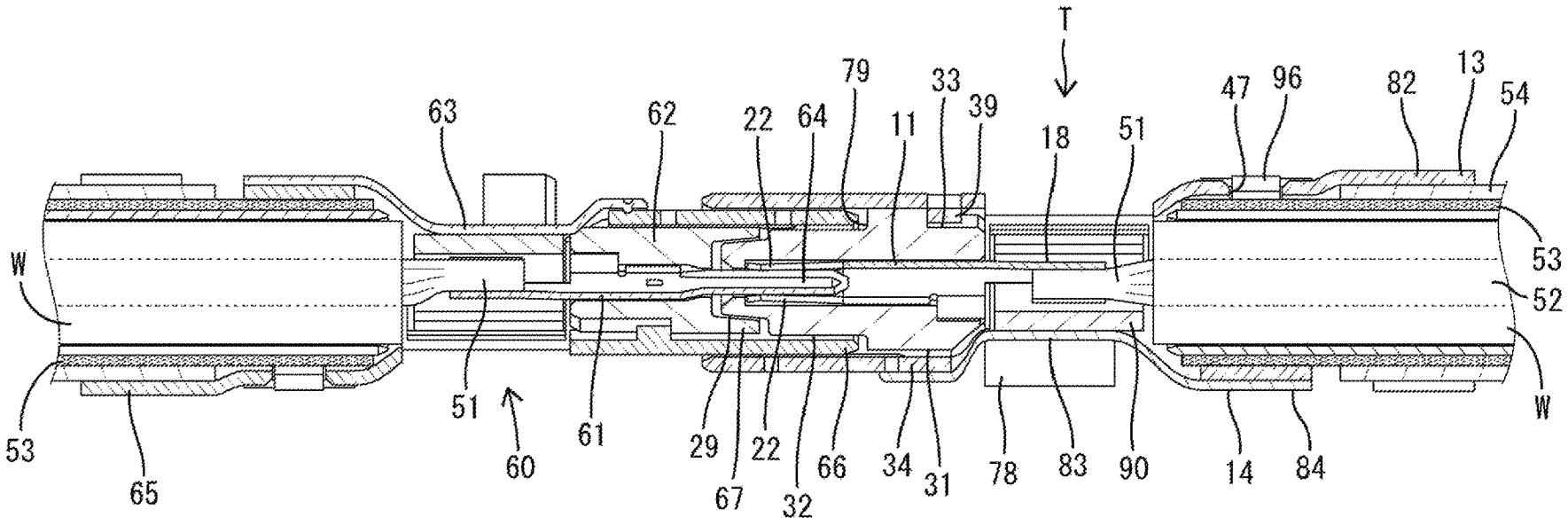
FIG. 12 is a section showing the connected state of the terminal fitting and the mating terminal fitting.

As shown in FIG. 12, the front circumferential surface 29 of the dielectric 13 is arranged along the inner peripheral surface of a fitting tube 67 of a mating dielectric 62 to be described later, and the intermediate circumferential surface 32 of the dielectric 13 is arranged along the inner surface of a tubular end portion 66 of a mating outer conductor 65 to be described later. Further, the rear variant surface 31 of the dielectric 13 is arranged along the inner peripheral surface of a later-described tubular portion 34 of the outer conductor 12. The dielectric 13 includes a stepped lock receiving portion 33 formed by cutting a rear part of the rear variant surface 31.

Figure 16:
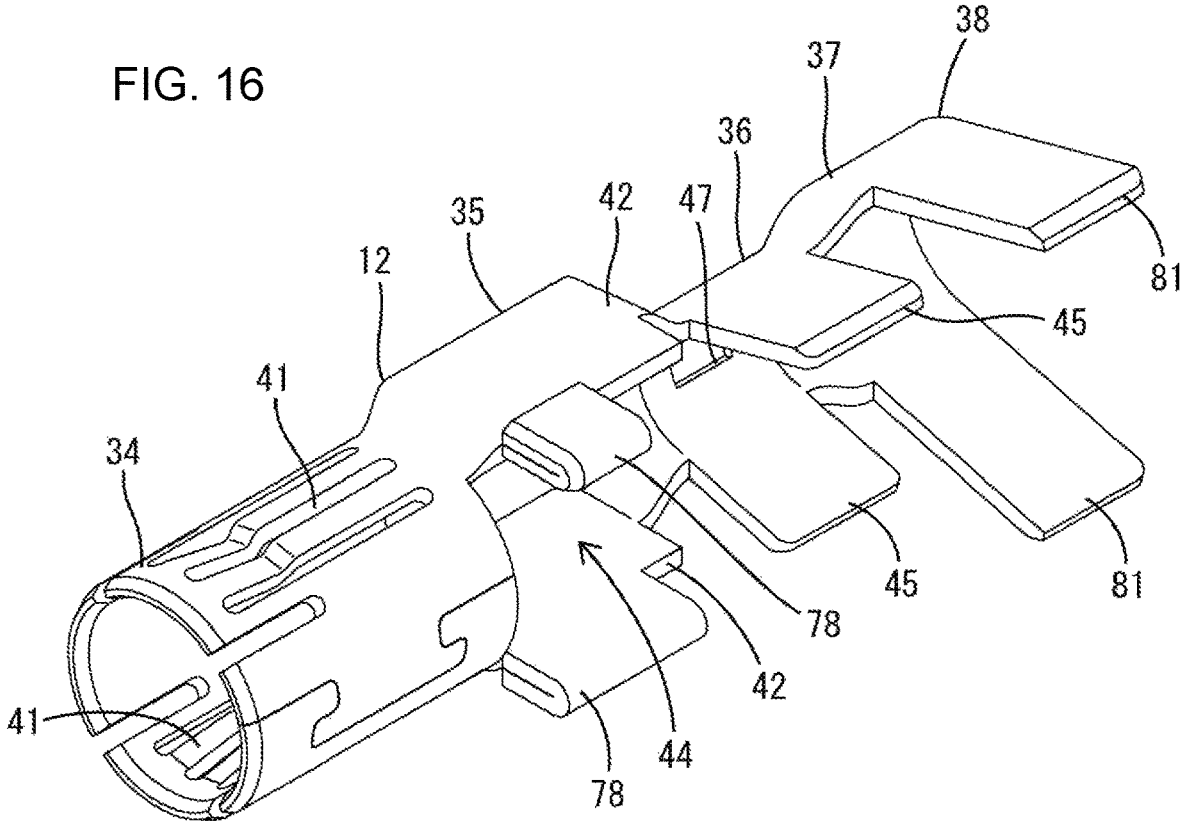
FIG. 16 is a perspective view of the outer conductor.

The outer conductor 12 is formed, such as by bending a metal plate, and is configured by successively connecting the tubular portion 34, a coupling portion 35, a shield crimping portion 36, an expanded coupling portion 37 and a sheath crimping portion 38 from a front end to a rear end, as shown in FIG. 16.

The tubular portion 34 is rounded to have a circular cross-section, and is held in a closed state by meshing projecting and recessed butting ends. The dielectric 13 is inserted into the tubular portion 34. As shown in FIG. 4, the dielectric 13 has rearward detachment from the tubular portion 34 restricted by a stepped locking portion 39 provided on a rear end part of the tubular portion 34 entering and locking the stepped lock receiving portion 33.

Figure 3:
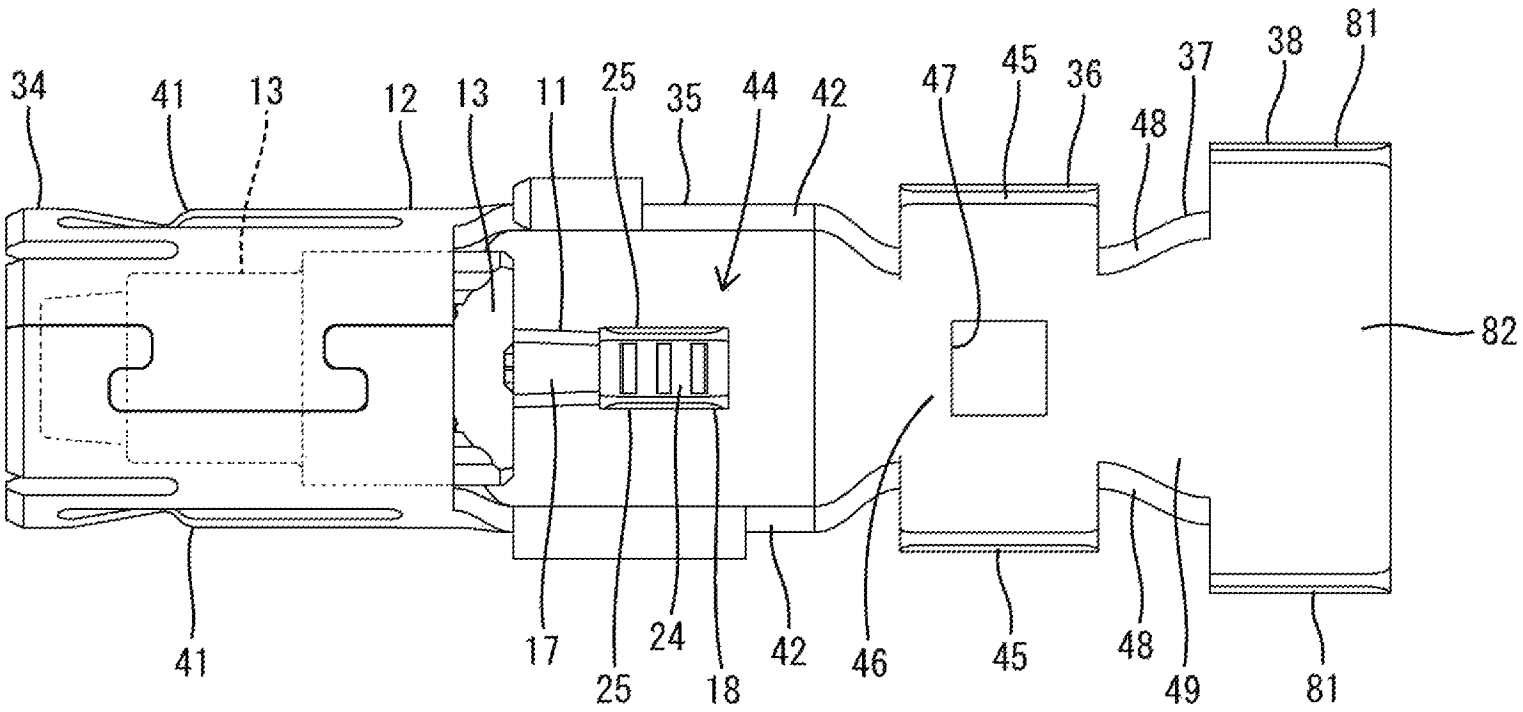
FIG. 3 is a view of the outer conductor having the inner conductor and the dielectric assembled therewith when viewed from a side opposite to a body.

As shown in FIGS. 3 and 16, the tubular portion 34 includes shield contact pieces 41 on the respective sides across the butting ends. Each shield contact piece 41 is provided between slits parallel to the front-rear direction in the tubular portion 34, and is deflectable with both front and rear ends as supports. Further, each shield contact piece 41 is bent to project into the tubular portion 34 and resiliently contacts the mating outer conductor 65 of the mating terminal fitting 60. In this way, the outer conductor 12 is connected electrically to the mating outer conductor 65.

The coupling portion 35 includes two side walls 42 connected to the rear ends of both side parts of the tubular portion 34. The side walls 42 are rectangular plates, connected to the sides of the tubular portion 34 across the butting ends and are arranged to face substantially in parallel along the front-rear direction. Spaces defined between the side walls 42 and between the tubular portion 34 and the shield crimping portion 36 are open toward both sides (vertical direction of FIG. 4) to define openings 43, 44, as shown in FIG. 4. The coupling portion 35 is composed of the side walls 42 and the openings 43, 44. The side walls 42 and the openings 43, 44 are provided alternately in a circumferential direction.

Unillustrated crimping tools (anvil, crimper) for the center conductor crimping portion 18 of the inner conductor 11 are inserted into the openings 43, 44. The openings 43, 44 include an anvil insertion opening 43 in which the center conductor-side body 24 is located, and a crimper insertion opening 44 in which tips of the center conductor crimping pieces 25 are located.

The coupling 35 includes stabilizers 78 projecting from the projecting ends of the side walls 42. The terminal fitting T is held retained in an unillustrated housing by the stabilizers 78 being locked to parts of the housing.

The shield crimping portion 36 includes two shield crimping pieces 45 and a shield-side body 46. The shield crimping pieces 45 are connected respectively to the rear ends of the side walls 42 and project in the same direction as the side walls 42 to form an open barrel. The shield-side body 46 is disposed between base end parts of the shield crimping pieces 45 and have a curved shape.

Figure 10:
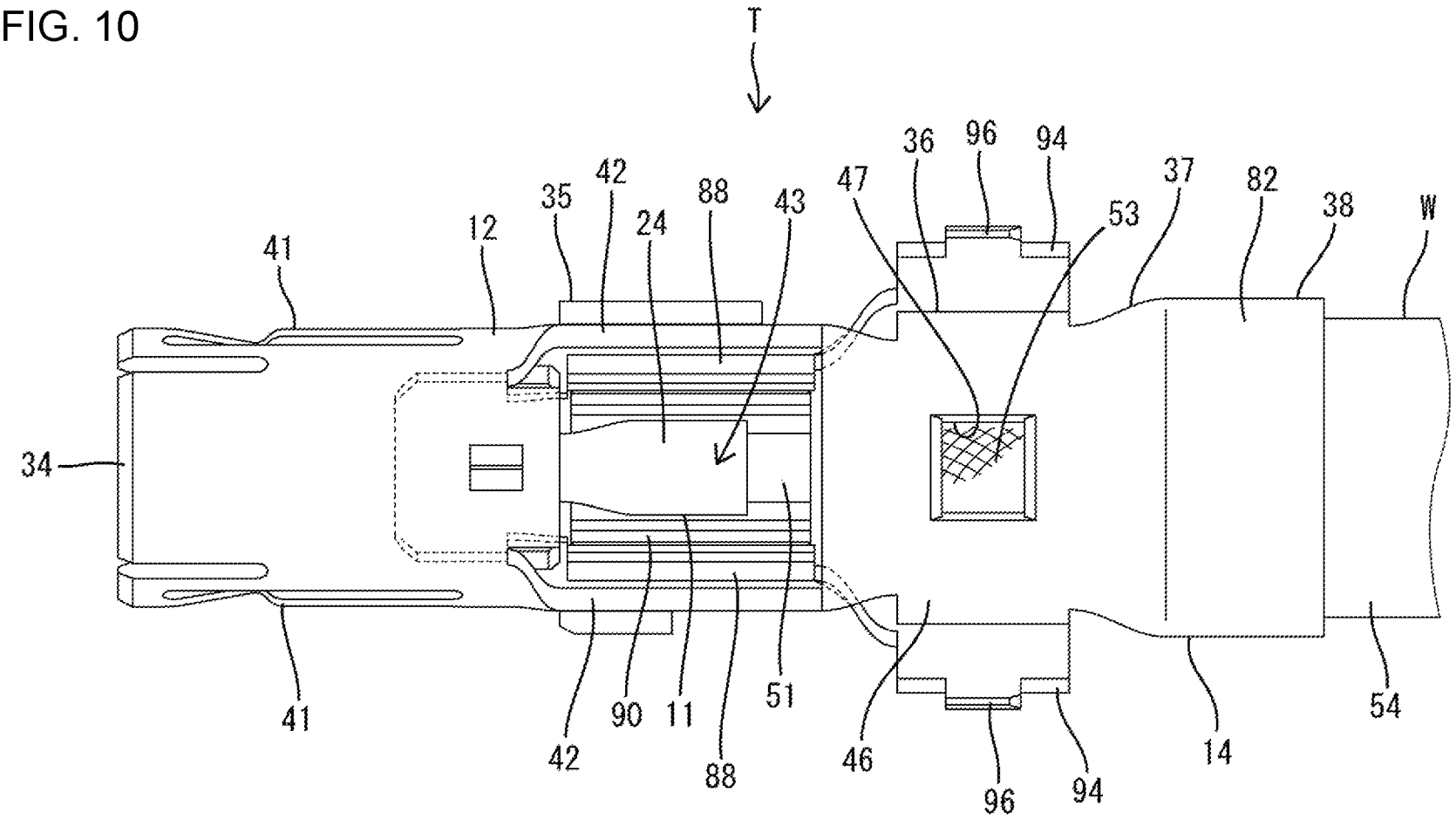
FIG. 10 is a view of the outer conductor viewed from the side of a body showing the state before the cover is set on the outer conductor and the surrounding portion is deformed into the surrounding form.
Figure 11:
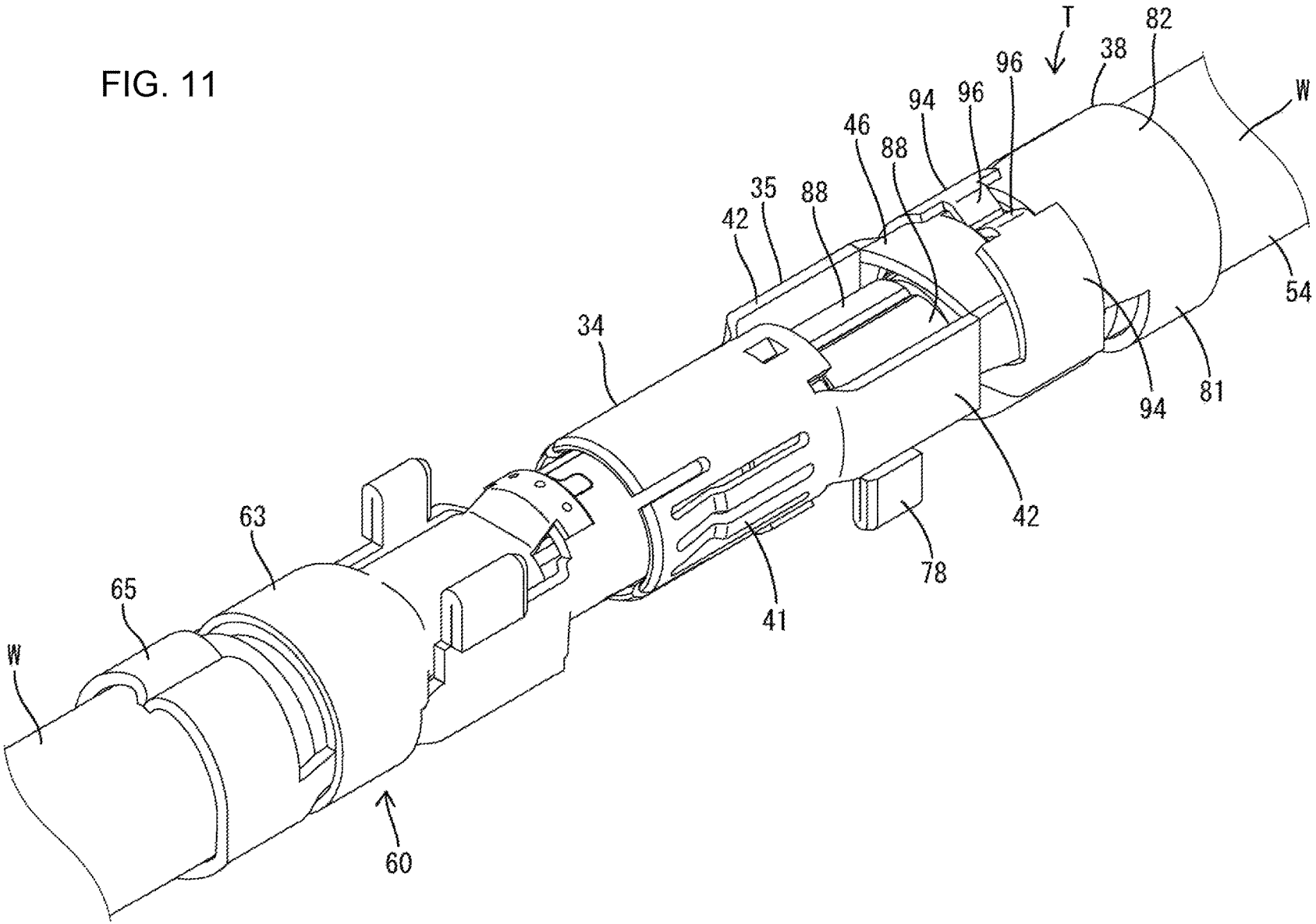
FIG. 11 is a perspective view showing a connected state of the terminal fitting and a mating terminal fitting.
Figure 17:
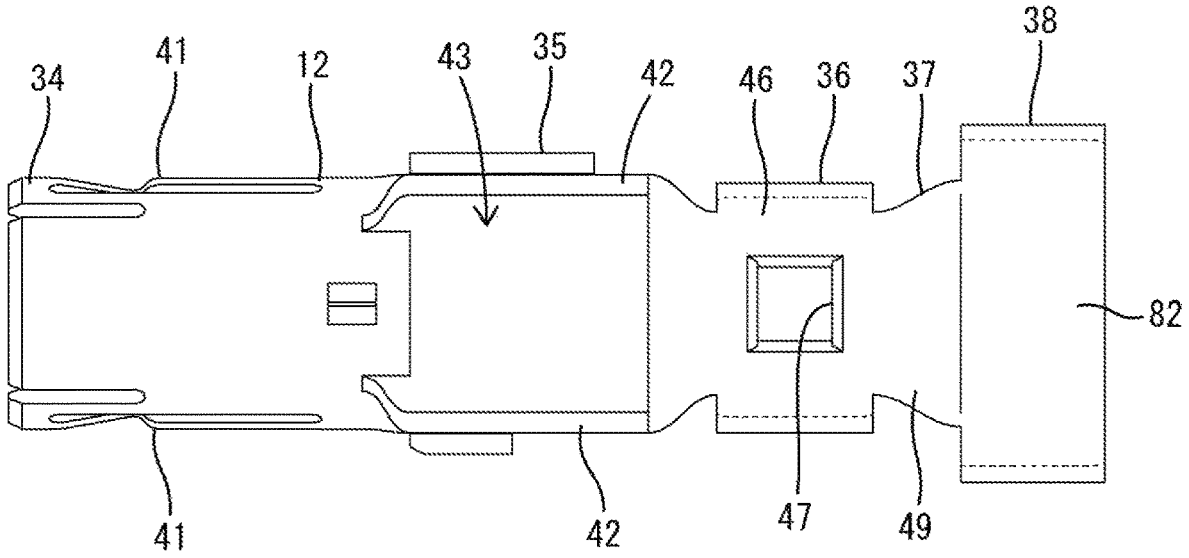
FIG. 17 is a view of the outer conductor viewed from the side of the body.

As shown in FIG. 10, the shield-side body 46 defines the rear end of the anvil insertion opening 43. As shown in FIG. 17, the shield-side body 46 has a penetrating locking hole 47 with a rectangular cross-section. The locking hole 47 is arranged in a central side of the shield crimping portion 36.

As shown in FIG. 3, the expanded coupling portion 37 includes two expanded side walls 48 connected to the rear ends of the shield crimping pieces 45 and an expanded body 49 connected to the rear end of the shield-side body 46 and having a curved shape. The expanded side walls 48 and the expanded body 49 are expanded gradually toward the rear.

The sheath crimping portion 38 includes two sheath crimping pieces 81 and a sheath-side body 82. The sheath crimping pieces 81 form an open barrel connected to the rear ends of the expanded side walls 48. The sheath-side body 82 is connected to the rear end of the expanded body 49 and has a curved shape. The sheath crimping pieces 81 and the sheath-side body 82 are slightly larger than the shield crimping pieces 45 and the shield-side body 46.

Figure 18:
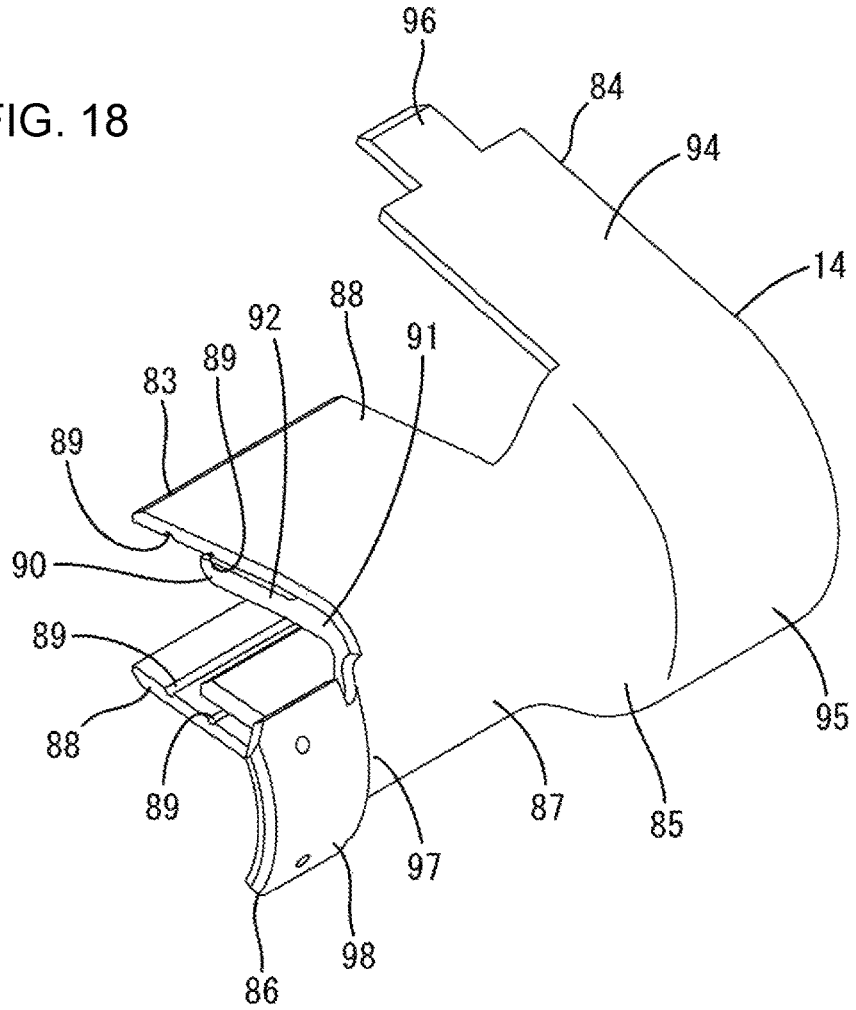
FIG. 18 is a perspective view of the cover.
Figure 19:
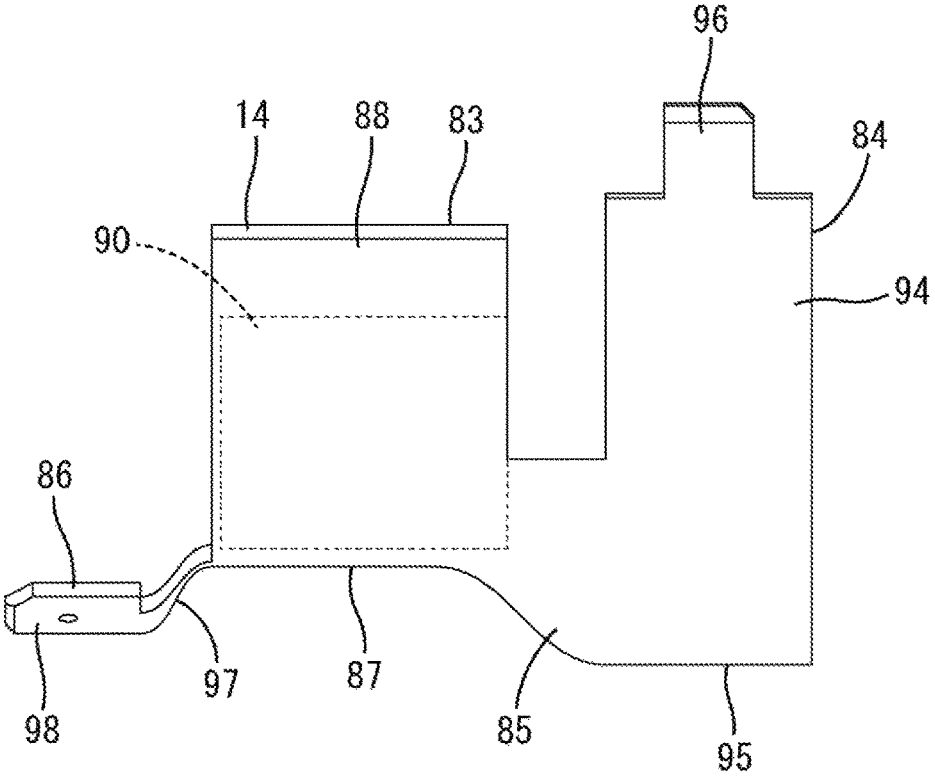
FIG. 19 is a view of the cover viewed from one side.

As shown in FIGS. 18 and 19, the cover 14 includes: an inner conductor-side surrounding portion 83 located on a front side, a shield-side surrounding portion 84 located on a rear side, a link 85 connecting the inner conductor-side surrounding portion 83 and the shield-side surrounding portion 84, and a connecting piece 86 projecting a short distance forward from the inner conductor-side surrounding portion 83.

The inner conductor-side surrounding portion 83 has a curved inner conductor-side surrounding body 87 and two inner conductor-side strips 88 projecting from sides of the inner conductor-side surrounding body 87. Each inner conductor-side strip 88 is a rectangular plate with two parallel notches 89 extending in the front-rear direction on the inner surface of a projecting tip, and is bendable inward with each notch 89 as a starting point.

Figure 6:
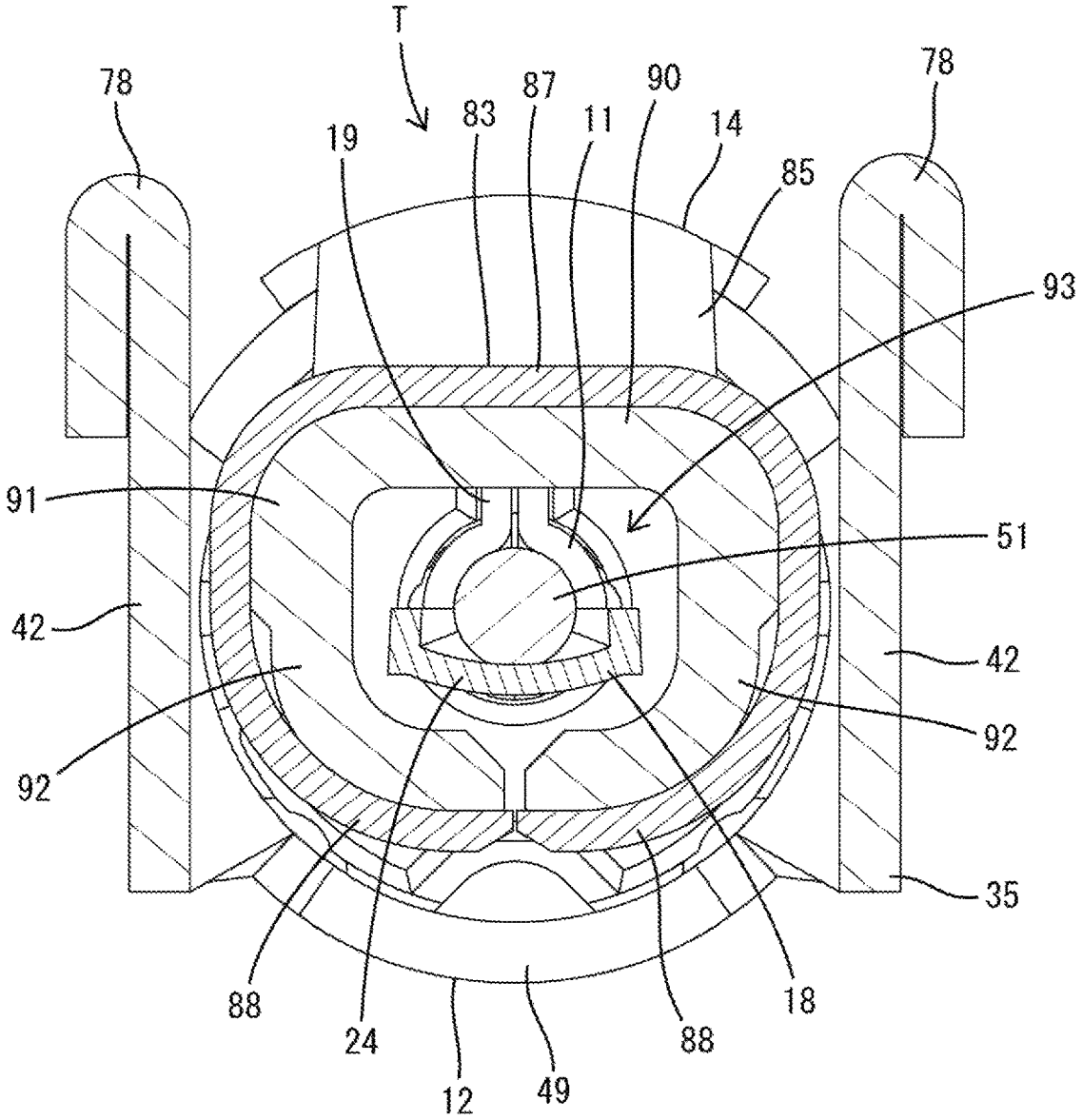
FIG. 6 is a section of the terminal fitting in a part passing through a center conductor crimping portion of the inner conductor.
Figure 20:
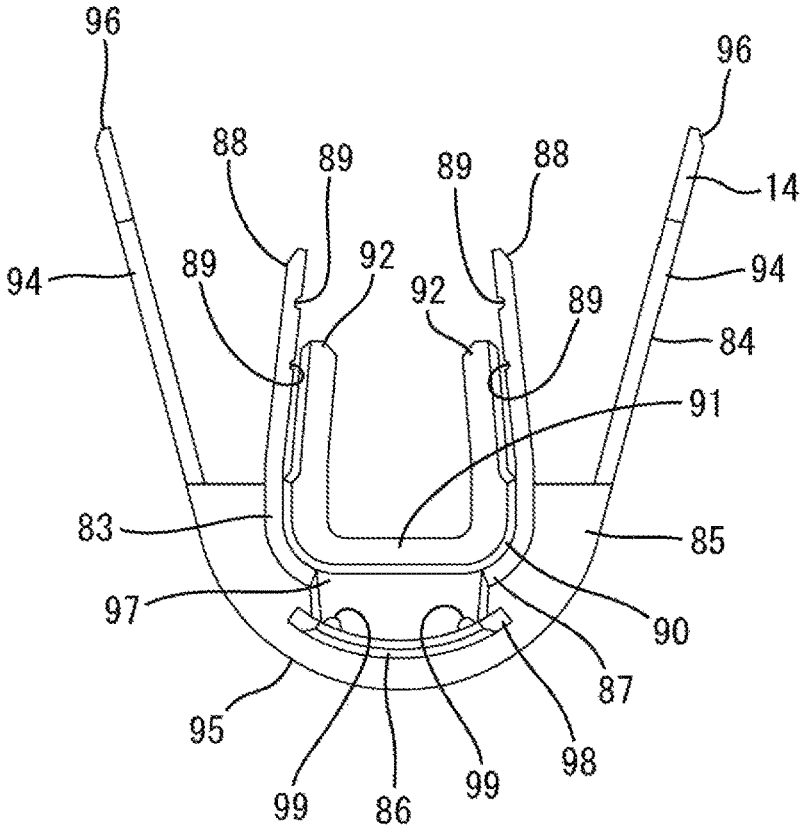
FIG. 20 is a front view of the cover.

An insulating surrounding portion 90 made of synthetic resin is provided along the inner surface of the inner conductor-side surrounding portion 83 except tips of the inner conductor-side strips 88. As shown in FIG. 20, the insulating surrounding portion 90 includes a close contact 91 to be held in close contact with the inner surfaces of the inner conductor-side surrounding body 87 and rising parts of the inner conductor-side strips 88 and two thin portions 92 separated from the inner conductor-side surrounding portion 83 on tip parts on the side of the notches 89. The thin portions 92 are bendable and deformable together with the inner conductor-side strips 88 with sides coupled to the close contact 91 as starting points. As shown in FIG. 6, the inner conductor-side strips 88 and the thin portions 92 are bent and deformed so that the inner conductor-side surrounding portion 83 forms a closed surrounding space 93 having a substantially circular cross-section. The center conductor crimping portion 18 is to be arranged in the surrounding space 93 of the inner conductor-side surrounding portion 83.

As shown in FIG. 20, the shield-side surrounding portion 84 includes a shield-side surrounding body 95 having a curved surface and two shield-side strips 94 projecting from both sides of the shield-side surrounding body 95. Each of the shield-side strips 94 is a rectangular plate and, as shown in FIG. 19, has a shorter dimension in the front-rear direction and a larger projecting dimension than the inner conductor-side strips 88.

The shield-side surrounding portion 84 includes locking pieces 96 in the form of plates partially projecting from central parts in the front-rear direction of the projecting tips of the shield-side strips 94. Each locking piece 96 is bendable with the tip side of the corresponding shield-side strip 94 as a starting point.

The link 85 is expanded gradually from the inner conductor-side surrounding portion 83 to the shield-side surrounding portion 84.

As shown in FIG. 19, the connecting piece 86 includes a connecting base 97 bent out and connected to the front end of the inner conductor-side surrounding body 87 and a connecting body 98 projecting forward from the connecting base 97 and having a curved shape substantially parallel to the inner conductor-side surrounding body 87. As shown in FIG. 20, the connecting body 98 includes two projecting contacts 99 protruding toward both sides of the connecting base 97 and projecting a short distance inward. The projecting contacts 99 are bulging embossments on both sides of the connecting body 98.

The mating terminal fitting 60, as a connection partner of the terminal fitting T, includes a mating inner conductor 61, the mating dielectric 62, the mating outer conductor 65 and a mating cover 63 as shown in FIG. 12. The mating inner conductor 61 is crimped and connected to the core 51 of the shielded cable W and includes a tab 64 projecting forward. The mating outer conductor 65 is crimped and connected to the braided wire 53 of the shielded cable W and includes the tubular end portion 66 on a front side. The mating dielectric 62 is between the mating inner conductor 61 and the mating outer conductor 65 and includes a fitting tube 67 surrounding a tip of the tab 64. The structure of the mating cover 63 is substantially the same as that of the cover 14.

An assembling method of the terminal fitting T including the inner conductor 11, the outer conductor 12, the dielectric 13 and the cover 14 is described below. First, the mating connecting portion 15 and the tubular portion 16 of the inner conductor 11 are inserted into the inner conductor insertion hole 26 of the dielectric 13. The link 17 and the center conductor crimping portion 18 of the inner conductor 11 then are arranged to project rearward from the rear surface of the dielectric 13.

The dielectric 13 then is inserted in the tubular portion 34 of the outer conductor 12 and is retained by locking the stepped locking portion 39 and the stepped lock receiving portion 33. A fitting space 79 is formed between the inner peripheral surface of the tubular portion 34 and the intermediate circumferential surface 32 of the dielectric 13 to receive the tubular end 66 of the mating terminal fitting 60 (see FIGS. 4 and 12).

The link 17 and the center conductor crimping portion 18 of the inner conductor 11 are arranged inside the coupling 35 of the outer conductor 12 (see FIG. 3). In particular, the center conductor crimping pieces 25 and the side walls 42 face each other while being spaced apart, and the two side walls 42 are arranged on the both sides across the center conductor crimping portion 18. The link 17 and the center conductor crimping portion 18 are exposed on the sides of the openings 43, 44 and can be seen through the openings 43, 44 before the cover 14 is mounted (see FIG. 4).

In the above state, the terminal fitting T is transported to a work site where a connecting operation to the shielded cable W is performed. In this case, both resilient pieces 22 of the inner conductor 11 are covered around by the dielectric 13 and the tubular portion 34. Thus, external matter cannot contact the resilient pieces 22 during transportation and at the work site so that the shapes of the resilient pieces 22 are maintained.

At the work site, the shielded cable W is pulled down from a state shown in FIG. 4 and placed on the outer conductor 12. Note that the shielded cable W is stripped beforehand to expose the core 51 and the braided wire 53 on a leading end part.

The core 51 of the shielded cable W is arranged to be supported on the center conductor-side body 24, the braided wire 53 is arranged to be supported on the shield-side body 46 and the sheath 54 thereof is arranged to be supported on the sheath-side body 82.

The anvil and the crimper of the unillustrated tools for the center conductor crimping portion are brought respectively into contact with the center conductor crimping portion 18 through the anvil insertion opening 43 and the crimper insertion opening 44. In that state, the anvil and the crimper are brought closer to each other. In this way, the center conductor crimping pieces 25 are bent to embrace the core 51 of the shielded cable W along the inner surface of the crimper and the inner conductor 11 is crimped and connected to the core 51.

The shield crimping portion 36 and the sheath crimping portion 38 are crimped by corresponding tools (anvil and crimper) from the outside of the outer conductor 12 before or after the crimping process of the center conductor crimping portion 18. In this way, the outer conductor 12 is crimped and connected to the braided wire 53 of the shielded cable W via the shield crimping portion 36 and crimped and connected to the sheath 54 of the shielded cable W via the sheath crimping portion 38.

Figure 8:
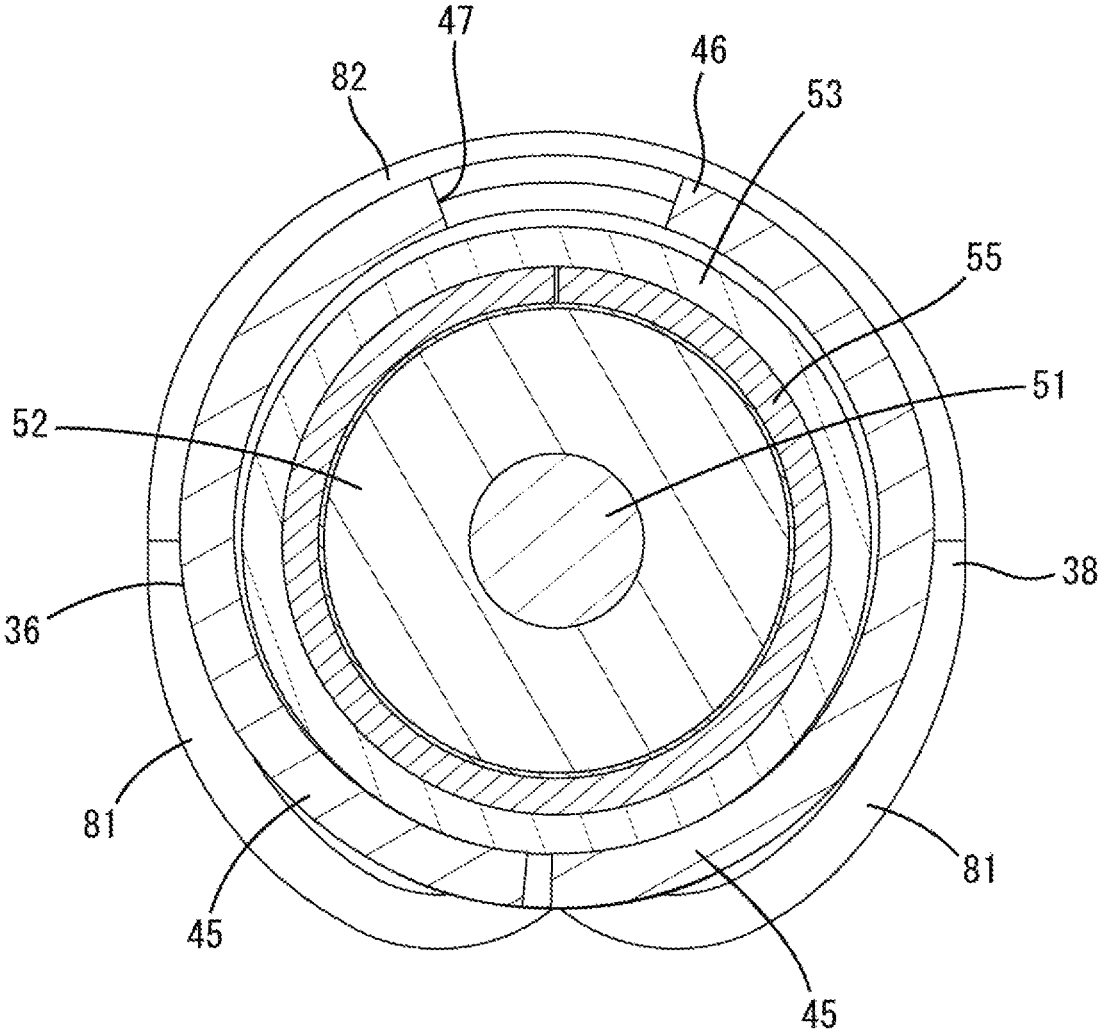
FIG. 8 is a section of the terminal fitting before the cover is mounted in FIG. 7.

The crimping tools bring the braided wire 53 of the shielded cable W into contact with the shield crimping portion 36 substantially along the circumferential direction at a compression ratio lower than normal and substantially uniform in the circumferential direction. Thus, the braided wire 53 is compressed gently by the shield crimping portion 36 and is maintained to have a substantially circular cross-section (see FIG. 8). Further, the shield crimping portion 36 also is formed to have a substantially circular cross-section.

Figure 7:
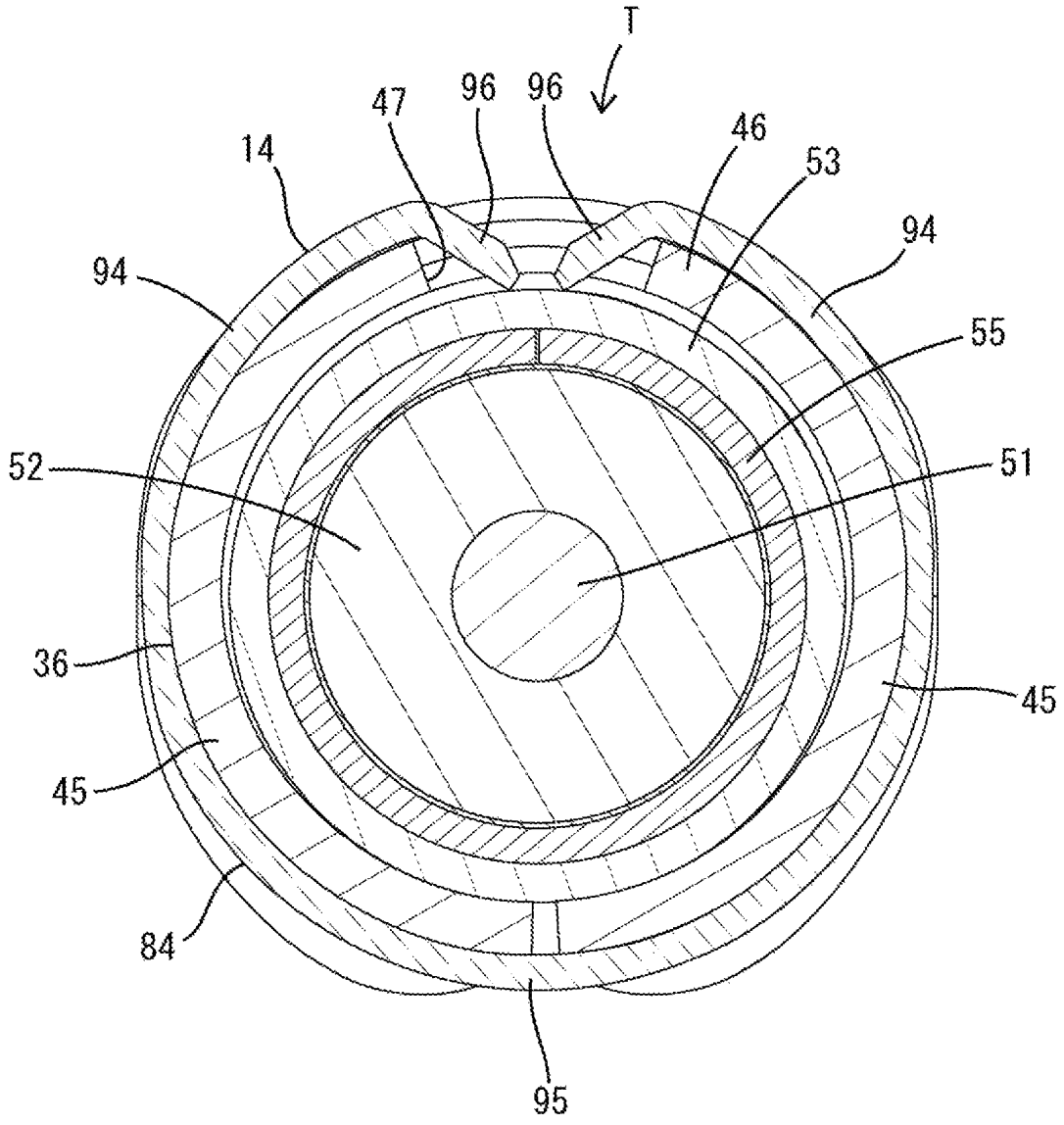
FIG. 7 is a section of the terminal fitting in a part passing through a shield crimping portion of the outer conductor.
Figure 9:
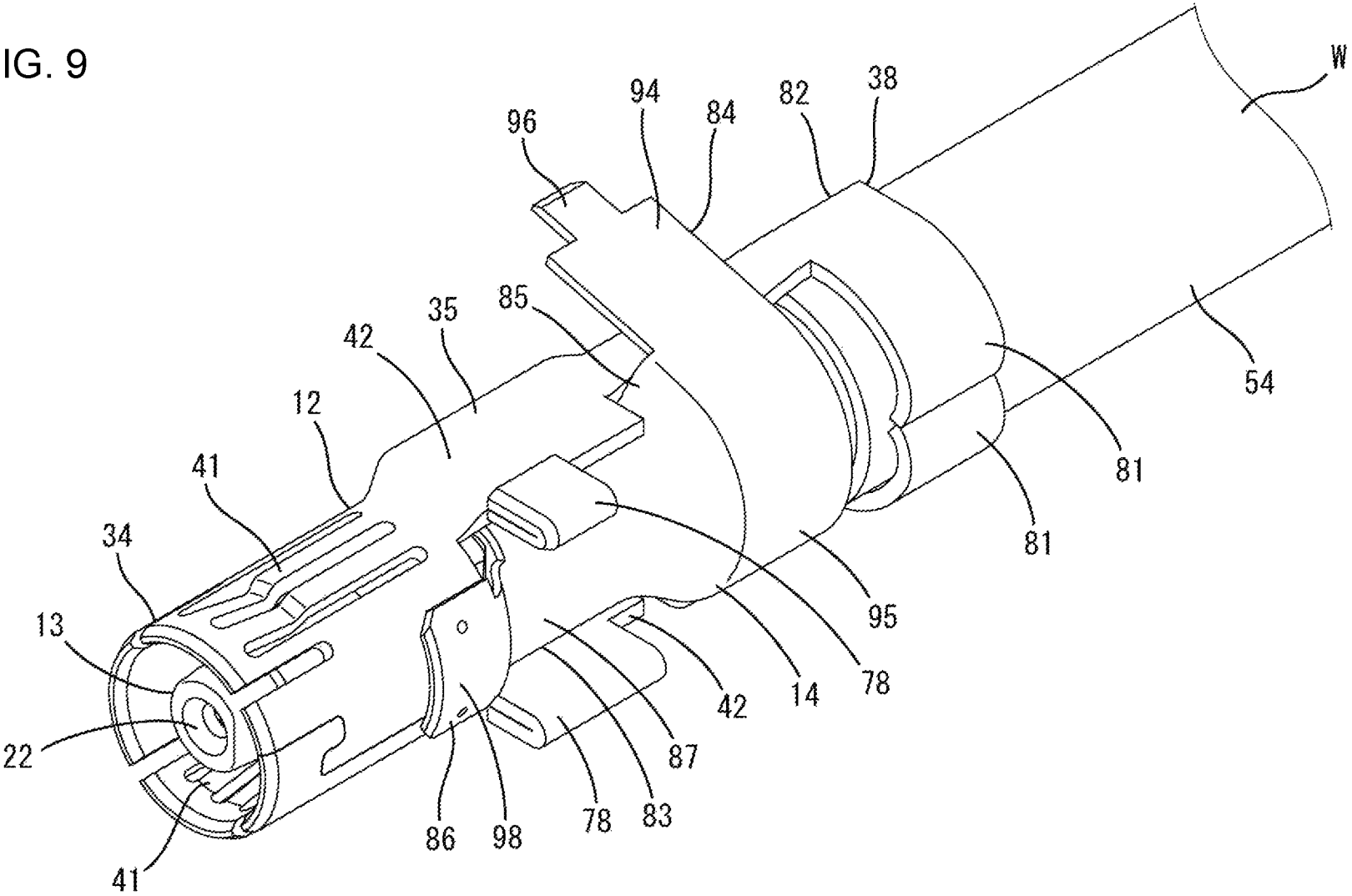
FIG. 9 is a perspective view of the terminal fitting before the cover is set on the outer conductor and a surrounding portion is deformed into a surrounding form.

The cover 14 subsequently is set to overlap the outer conductor 12. Then, the inner conductor-side surrounding portion 83 is inserted between the side walls 42 and the inner conductor-side surrounding body 87 substantially closes the crimper insertion opening 44 of the coupling 35 (see FIG. 9). Further, the shield-side surrounding portion 84 is arranged outside the shield crimping pieces 45, and the shield-side surrounding body 95 is arranged along the outer peripheral surfaces of the shield crimping pieces 45 while covering the butting ends of the shield crimping pieces 45 from outside. Furthermore, the connecting body 98 of the connecting piece 86 is supported on the outer peripheral surface of the tubular portion 34 and the projecting contacts 99 of the connecting body 98 contact the outer peripheral surface of the tubular portion 34 while being spaced apart in the circumferential direction. The link 85 contacts an end edge of the coupling 35 to be supported between the inner conductor-side surrounding portion 83 and the shield-side surrounding portion 84. Thus, the tips of both inner conductor-side strips 88 are located on a side opposite to the tips (butting ends) of the center conductor crimping pieces 25 and the tips of the shield-side strips 94 are located on a side opposite to the tips (butting end sides) of the shield crimping pieces 45 (see FIG. 7).

In that state, unillustrated tools (anvil and crimper) contact and deform the shield-side surrounding portion 84 to a substantially circular cross-section. Simultaneously with or before or after that, unillustrated tools (anvil and crimper) contact and deform the inner conductor-side surrounding portion 83 to a substantially circular cross-section.

For the shield-side surrounding portion 84, the shield-side strips 94 are deformed arcuately along the outer peripheral surface of the shield-side body 46 and the locking pieces 96 are bent toward the locking hole 47 of the shield-side body 46. The locking pieces 96 enter one locking hole 47 from both sides to be locked to end edges of the locking hole 47 (see FIG. 7). In this way, the shield-side surrounding portion 84 is held to have a circular cross-sectional shape without expanding. Then, the shield-side surrounding portion 84 is maintained in a state surrounding the shield crimping portion 36 and, simultaneously, the shield crimping pieces 45 are held to have a circular cross-sectional shape without being expanded. Unlike a normal crimping process, the shield-side surrounding portion 84 does not strongly compress both sides of the shield crimping portion 36 so that the shield crimping portion 36 keeps a circular cross-sectional shape. Note that the tips of the locking pieces 96 that have entered the locking hole 47 are arranged in contact with the braided wire 53.

For the inner conductor-side surrounding portion 83, the tools are inserted through the openings 43, 44 and the inner conductor-side strips 88 are bent arcuately inward together with the thin portions 92 of the insulating surrounding portion 90 (see FIG. 6). In this way, the tips of the inner conductor-side strips 88 substantially but against each other and the surrounding space 93 for surrounding the center conductor crimping portion 18 is formed inside the inner conductor-side surrounding portion 83. The center conductor crimping portion 18 is surrounded by the inner conductor-side surrounding portion 83 in an insulated state via the insulating surrounding portion 90. Further, the openings 43, 44 are substantially closed by the inner conductor-side surrounding portion 83. In particular, the connecting piece 86 and the shield-side surrounding body 95 are disposed between the tubular portion 34 and the shield crimping pieces 45 while the inner conductor-side surrounding body 87 substantially closes the crimper insertion opening 44. Additionally, the inner conductor-side strips 88 are arranged between the tubular portion 34 and the shield-side body 46 while substantially closing the anvil insertion opening 43. In this way, the opening shape and stepped shape of the coupling 35 are substantially eliminated.

When the mating terminal fitting 60 is connected to the terminal fitting T, the tip of the dielectric 13 is fit into the fitting tube 67 of the mating dielectric 62 and the tubular end 66 of the mating outer conductor 65 is fit into the fitting space 79 of the terminal fitting T (see FIG. 12). The tab 64 of the mating inner conductor 61 is inserted between the resilient pieces 22 of the inner conductor 11 to electrically contact the contact points 23 of the resilient pieces 22. In this way, a signal conductive path is formed between the terminal fittings T, 60 via the inner conductor 11 and the mating inner conductor 61.

The terminal fitting T described above exhibits the following effects.

After the inner conductor 11 is assembled with the outer conductor 12, the tools for the center conductor crimping portion 18 are brought into contact with the center conductor crimping portion 18 through the openings 43, 44 and the center conductor crimping portion 18 is crimped to the core 51 of the shielded cable W. Thus, assembling work is improved, and the resilient pieces 22 of the mating connecting portion 15 are covered and protected by the tubular portion 34 of the outer conductor 12, such as during transportation.

The flow of a current may be impeded there and high frequency performance may be reduced, if the openings 43, 44 are present in the outer conductor 12. However, the inner conductor-side surrounding portion 83 of the cover 14 substantially closes the openings 43, 44 and the cover 14 electrically contacts the outer conductor 12 via the connecting piece 86 and the shield-side surrounding portion 84. Thus, the flow of a shield current is ensured through the cover 14 and high frequency performance is improved.

The mating connecting portion 15 of the inner conductor 11 is not provided with a tubular part for covering the resilient pieces 22. Thus, external dimension differences between the mating connecting portion 15 and the mating terminal fitting 60 are small and a characteristic impedance is improved.

The cover 14 electrically contacts both the shield crimping portion 36 and the tubular portion 34. Thus, the shield current can flow substantially straight via the cover 14 even at a position corresponding to the coupling 35, and high frequency characteristic can be improved.

The shield crimping pieces 45 are crimped to the braided wire 53 of the shielded cable W at a low compression ratio. Thus, the braided wire 53 will not deform or fracture in a distorted manner. As a result, the shielding performance of the braided wire 53 is not reduced. Shield crimping pieces 45 could expand due to an insufficient crimping force on the braided wire 53. However, the shield-side surrounding portion 84 of the cover 14 surrounds the shield crimping pieces 45 from outside and prevent the shield crimping pieces 45 from inadvertently expanding.

The cover 14 has a function of suppressing expanding movements of the shield crimping pieces 45 and a function of improving high frequency performance. Thus, the configuration of the terminal fitting T is simplified and the number of components is reduced as compared to the case where these functions are realized by different members.

The shield-side surrounding body 95 of the cover 14 covers the tips of the shield crimping pieces 45 to suppress expanding movements of the shield crimping pieces 45.

The locking pieces 96 of the shield-side strips 94 enter the locking hole 47 of the shield-side body 46 and are locked to the outer conductor 12. Thus, expanding movements of the shield-side strips 94 are suppressed.

The insulating surrounding portion 90 is between the inner conductor-side surrounding portion 83 and the center conductor crimping portion 18 to prevent a short circuit between the inner conductor 11 and the outer conductor 12. In addition, the inner conductor-side strips 88 have the notches 89 and the insulating surrounding portion 90 has the thin portions 92. Thus, the insulating surrounding portion 90 can be bent as the inner conductor-side strips 88 are bent to improve work efficiency and to prevent damaging the insulating surrounding portion 90.

Other embodiments are described briefly below.

The coupling may include a bottom wall intersecting the both side wall portions and the anvil insertion opening may be open in a central side of the bottom wall.

The opening of the coupling may be composed of only the crimper insertion opening, and the anvil insertion opening may be closed.

The braided wire, the shield crimping portion and the shield-side surrounding portion may be deformed from the circular cross-sectional shape to such an extent that the braided wire is not excessively biased.

The mating terminal fitting may be connected directly to a shield conductive path of a printed circuit board without a shielded cable.

LIST OF REFERENCE SIGNS

T . . . terminal fitting
W . . . shielded cable
11 . . . inner conductor
12 . . . outer conductor
14 . . . cover
18 . . . center conductor crimping portion
22 . . . resilient piece
34 . . . tubular portion
35 . . . coupling
36 . . . shield crimping portion
43 . . . anvil insertion opening (opening)
44 . . . crimper insertion opening (opening)
45 . . . shield crimping piece
47 . . . locking hole
60 . . . mating terminal fitting
83 . . . inner conductor-side surrounding portion
84 . . . shield-side surrounding portion (surrounding portion)
86 . . . connecting piece
94 . . . shield-side strip (strip)

What is claimed is:

1. A terminal fitting, comprising:

an outer conductor including two shield crimping pieces deformable along an outer periphery of a shield layer of a shielded cable so that tips of the shield crimping pieces oppose one another; and a cover formed from a conductive metal and including a surrounding portion having a surrounding body covering the tips of the shield crimping pieces and two opposed strips projecting from opposite sides of the surrounding body, the strips surrounding and engaging the shield crimping pieces along outer peripheries thereof.

2. The terminal fitting of claim 1, wherein the shield crimping pieces rise from a body of the outer conductor.

3. The terminal fitting of claim 2, wherein the body of the outer conductor includes a locking hole, and tips of the strips of the cover enter the locking hole to be locked to the outer conductor.

4. The terminal fitting of claim 1, further comprising an inner conductor including a center conductor crimping portion to be crimped to a center conductor of the shielded cable, wherein:

the outer conductor includes a coupling, the center conductor crimping portion being disposed inside the coupling, and an opening open in the coupling, and the cover closes the opening and electrically contacts the outer conductor.

5. The terminal fitting of claim 4, wherein the coupling includes two opposed side walls, the opening in the coupling includes an anvil insertion opening between the side wall of the coupling and a crimper insertion opening between the side walls of the coupling and opposed to the anvil insertion opening, the cover further includes an inner conductor-side surrounding body and two inner conductor-side strips projecting from opposite sides of the inner conductor-side surrounding body, the inner conductor-side surrounding body covering the crimper insertion opening, the two inner conductor-side strips being inward of the two opposed side walls of the coupling and being crimped to close the anvil insertion opening.

6. The terminal fitting of claim 1, wherein the outer conductor further comprises a tubular portion and a coupling extending between the tubular portion and the shield crimping pieces, the cover includes a connecting piece supported on an outer surface of the tubular portion of the outer conductor.

* * * * *